US007891344B2

(12) United States Patent
Miyazaki et al.

(10) Patent No.: US 7,891,344 B2
(45) Date of Patent: Feb. 22, 2011

(54) FUEL TANK

(75) Inventors: Akihiro Miyazaki, Shizuoka-ken (JP); Takahide Sugiyama, Shizuoka-ken (JP); Shinichi Kajiya, Shizuoka-ken (JP)

(73) Assignee: Yamaha Motor Power Products Kabushiki Kaisha, Shizuoka (JP)

( * ) Notice: Subject to any disclaimer, the term of this patent is extended or adjusted under 35 U.S.C. 154(b) by 412 days.

(21) Appl. No.: 12/108,241

(22) Filed: Apr. 23, 2008

(65) Prior Publication Data

US 2008/0264501 A1 Oct. 30, 2008

(30) Foreign Application Priority Data

Apr. 24, 2007 (JP) ..... 2007-114516

(51) Int. Cl.
*F02M 37/20* (2006.01)
*F02M 37/00* (2006.01)

(52) U.S. Cl. ..... 123/516

(58) Field of Classification Search ..... 123/516, 123/518, 519, 520; 137/840, 171, 179, 213, 137/216, 216.2, 583, 587, 588, 589, 43; 220/746, 220/DIG. 33
See application file for complete search history.

(56) References Cited

U.S. PATENT DOCUMENTS 4,312,649 A * 1/1982 Fujii et al. ..... 96/109
4,646,701 A * 3/1987 Fukumoto ..... 123/519
5,542,706 A * 8/1996 Kubly ..... 280/833
7,086,389 B2 * 8/2006 Yamada ..... 123/516
7,353,808 B2 * 4/2008 Kakoo ..... 123/516

FOREIGN PATENT DOCUMENTS

JP 2005-163688 6/2005

OTHER PUBLICATIONS

U.S. Appl. No. 12/106,786, filed Apr. 21, 2008, Naoki Kamoshita.

* cited by examiner

*Primary Examiner*—Mahmoud Gimie
(74) *Attorney, Agent, or Firm*—Keating & Bennett, LLP

(57) ABSTRACT

A fuel tank has a tank body and a fuel inlet projecting upwardly from the tank body. The fuel tank includes a cylindrical member extending into the tank body, a canister, and a discharging passage in communication with the canister housing an adsorbent for absorbing fuel vapor from the fuel tank. A space between an outer circumferential surface of the cylindrical member and an inner circumferential surface of the fuel inlet is hermetically sealed by a seal. The cylindrical member has a passage for communicating an inside of the cylindrical member with a portion of an outside of the cylindrical member that is lower than the hermetically sealed space. The passage allows air in the tank body to enter the fuel inlet when fuel overflows from the fuel inlet, thereby inhibiting flow of fuel into the canister through the discharging passage.

9 Claims, 6 Drawing Sheets

FUEL TANK

CROSS-REFERENCE TO RELATED APPLICATIONS

The present application is based on and claims priority under 35 U.S.C. 119 to Japanese Patent Application No. 2007-114516, filed on Apr. 24, 2007, the entire contents of which is hereby incorporated by reference and should be considered part of this specification

BACKGROUND OF THE INVENTION

1. Field of the Invention

The present invention relates to a fuel tank mounted on an apparatus that carries an engine thereon, such as an engine generator and a general-purpose engine.

2. Description of the Related Art

An example of a conventional fuel tank mounted on a general-purpose engine is described in Japanese Publication No. JP-2005-163688. Such a fuel tank includes a tank body for storing fuel therein, a fuel inlet provided on a top face of the tank body and projecting upwardly therefrom, and a fuel cap removably installed on the fuel inlet.

As apparent from FIG. 6 of JP-2005-163688, a fuel tank 48 according to JP-2005-163688 is disadvantageous in that, with the fuel tank 48 that includes a groove 79 having a relatively-large cross-sectional area to bring an evaporative fuel passage 78 into communication with the fuel tank 48, if fuel is accidentally oversupplied to reach an upper end of the fuel inlet, air in the fuel tank 48 at a portion radially outward from a seal support 59 easily escapes through the groove 79 to the outside of the fuel tank 48. Accordingly, the fuel remains filled to the upper end, and hence a liquid level of the fuel in the fuel inlet does not decline.

In contrast, when the fuel tank 48 includes the groove 79 having a relatively-small cross-sectional area, if fuel is accidentally supplied to the upper end of the fuel inlet, air less easily flows out through the groove 79. More specifically, because a channel in the groove 79 extends horizontally, a buoyant force urges bubbles generated from the fuel and air in the fuel tank 48 to move upward. Hence, the bubbles remain clogged in the groove 79 and less easily escape out through the groove 79. Consequently, air is trapped in the fuel tank 48 and the liquid level of the portion radially outward from the seal support 59 does not rise to be higher than a lower end of the seal support 59. Hence, the liquid level of the fuel in the fuel inlet does not decline.

As described above, in either case in which the groove 79 is large or small in cross-sectional area, fuel can flow into a canister through piping provided for guiding evaporative fuel vapor produced in the fuel tank to the canister, thereby functionally damaging the canister.

SUMMARY OF THE INVENTION

In view of the circumstances noted above, one aspect of the present invention is to provide a fuel tank capable of preventing fuel from accidentally flowing into a canister during fueling.

In accordance with one aspect of the present invention, a fuel tank is provided comprising a tank body for storing fuel therein, a fuel inlet extending upwardly from a top face of the tank body, and a fuel cap configured to be removably installed on the fuel inlet. The fuel tank further comprises a cylindrical member having a lower end that is open at a position lower than a top face of the tank body and projecting downwardly in the fuel inlet, with a space between an outer circumferential surface of an upper end portion of the cylindrical member and an inner circumferential surface of the fuel inlet being maintained in a hermetically sealed state. The cylindrical member has, in an upper end portion of the cylindrical member, a communicating passage for bringing an inside of the cylindrical member into communication with a portion of an outside of the cylindrical member, the portion being lower than the hermetically sealed space, the communicating passage extending substantially vertically. A canister adsorbs fuel vapor in the tank body thereonto. A discharging passage of a discharging member is in communication with the canister, the discharging member having an opening in the cylindrical member at a position higher than the lower end of the cylindrical member.

In accordance with another aspect of the present invention, a fuel tank is provided comprising a tank body for storing fuel therein and a fuel inlet extending upwardly from a top face of the tank body, the fuel inlet removably coupleable to a fuel cap. A cylindrical member is positioned in the tank body, the cylindrical member having a distal end positioned below a top face of the tank body. An outer surface of the cylindrical member is sealed relative to an inner surface of the fuel inlet, the cylindrical member having a communicating passage configured to communicate an inside of the cylindrical member with an outside portion of the cylindrical member, said outside portion being lower than the sealed space. A discharge member is coupleable with a canister for adsorbing vapor fuel thereonto, the discharge member defining a discharging passage therein placeable in communication with the canister, the discharge member disposed inwardly of the cylindrical member and having an opening positioned higher than a lower end of the cylindrical member.

In accordance with another aspect of the present invention, a fuel tank is provided comprising a tank body for storing fuel therein and a fuel inlet extending upwardly from a top face of the tank body, the fuel inlet removably coupleable to a fuel cap. The fuel tank also comprises means for allowing air in the tank body to enter the fuel inlet when fuel is oversupplied into and overflows from the fuel inlet, thereby causing said air to escape out of the fuel inlet so that a fuel level in the fuel inlet declines and a fuel level in the tank body rises.

BRIEF DESCRIPTION OF THE DRAWINGS

These and other features, aspects and advantages of the present invention will now be described in connection with preferred embodiments of the invention, in reference to the accompanying drawings. The illustrated embodiments, however, are merely examples and are not intended to limit the invention. The drawings include the following 6 figures.

DETAILED DESCRIPTION OF THE PREFERRED EMBODIMENTS

Figure 1:
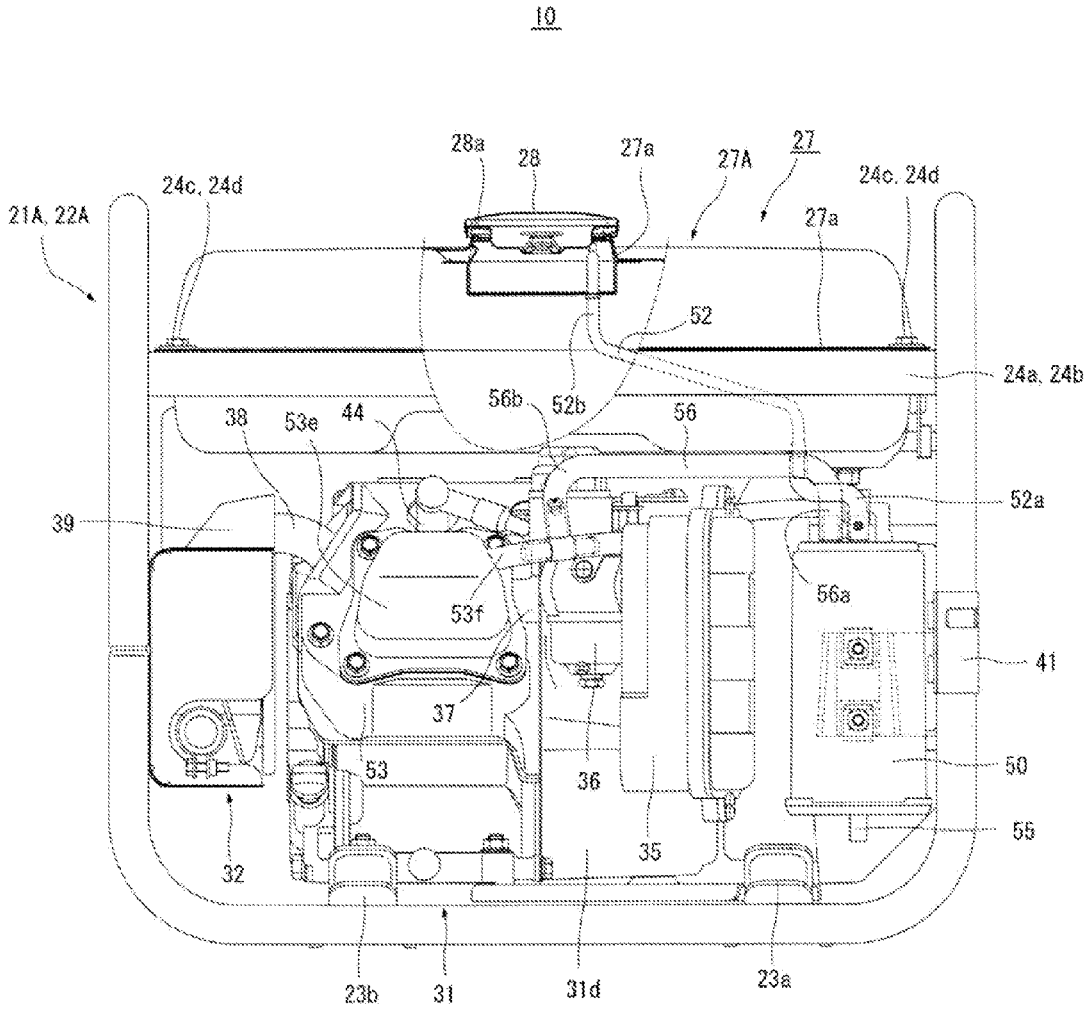
FIG. 1 is a front view of one embodiment of an engine generator with a fuel tank partially cut away.

FIG. 1 shows an engine generator 10 with one embodiment of a fuel tank 27 mounted thereon. FIG. 1 is a front view of the engine generator 10 with the fuel tank 27 partially cut away. Frames 21A and 22A, each of which can be substantially U-shaped in front view, can be provided on the front and rear of the engine generator 10, respectively. Bottoms of the frames 21A and 22A can be connected to each other with bottom-connecting frames 23*a* and 23*b* therebetween, respectively. An upper right portion and an upper left portion of each of the frames 21A and 22A can be connected to each other with a corresponding one of top-connecting frames 24*a* and 24*b* therebetween.

An engine 31 and a generator 32 can be juxtaposed in the substantially U-shaped frames 21A and 22A. A suction fan 31*d* in the engine 31 preferably sucks outside air into the engine generator 10 to cool the engine 31. The air is thereafter discharged outside of the engine generator 10.

An air cleaner 35 can be provided in the engine generator 10, for example, at a substantially vertical center of a right front portion of the engine generator 10. A carburetor 36 can be positioned adjacent to the air cleaner 35 to be closer to the engine 31 than the air cleaner 35. The air cleaner 35 positioned on an air-intake side of the engine 31, preferably receives the outside air, cleans the air, and supplies the cleaned air to the carburetor 36.

Fuel supplied from the fuel tank 27 to the carburetor 36 can be mixed with air supplied through the air cleaner 35 to the carburetor 36. The resultant air-fuel mixture can be supplied to the engine 31 through an intake pipe 37. The engine 31 includes at least one spark plug 44 for igniting the air-fuel mixture supplied from the carburetor 36 to produce combustion in the engine 31, thereby running the engine 31. Blow-by gas that fills a cylinder-head cap 53*e* of a cylinder head 53 can be returned to the air cleaner 35 through a blow-by gas pipe 53*f*, mixed with air, and subjected to re-combustion so that the blow-by gas does not escape into the atmosphere.

A muffler 39 can be provided on an exhaust side of the engine 31 with an exhaust pipe 38 therebetween. Exhaust gas discharged from the engine 31 is muffled through the muffler 39, and then discharged to the atmosphere.

The generator 32 is provided in the engine generator 10, and the fuel tank 27 can be positioned above the generator 32 and the engine 31. A flange 27*a* of the engine 31 can be fastened to the top-connecting frames 24*a* and 24*b*, which can be attached to the frames 21A and 22A with bolts 24*c* and 24*d*, or other suitable fasteners respectively.

A canister 50 can be fixed to the air-intake side of the engine 31 with a canister mounting bracket 41 therebetween on the frame 21A. A downstream end 52*a* of a discharging passage 52 is connected to the canister 50, and an upstream end 52*b* of the discharging passage 52 is connected to the fuel tank 27. The discharging passage 52 can be formed with a metal pipe. However, other suitable materials can be used.

The fuel tank 27 includes a tank body 27A for storing fuel therein and a fuel inlet 27*a* provided on a top face of the tank body 27A and projecting upwardly therefrom. A fuel cap 28 is removably installed on the fuel inlet 27*a*. When the fuel cap 28 is installed on the fuel inlet 27*a*, an annular seal 28*a* can seal an opening of the fuel inlet 27*a*.

Fuel vapor produced in the fuel tank 27 is guided to the canister 50 through the discharging passage 52. An air release pipe 55 can be connected to the canister 50 to open the canister 50 to the atmosphere. A first end 56*a* of a purge pipe 56 can be connected with the canister 50, and a second end 56*b* of the purge pipe 56*b* can be connected with the blow-by gas pipe 53*f*. Because the canister 50 is in communication with the suction side of the engine 31 through the purge pipe 56 and the blow-by gas pipe 53*f*, fuel adsorbed onto the canister 50 is returned to the suction side of the engine 31.

Figure 2:
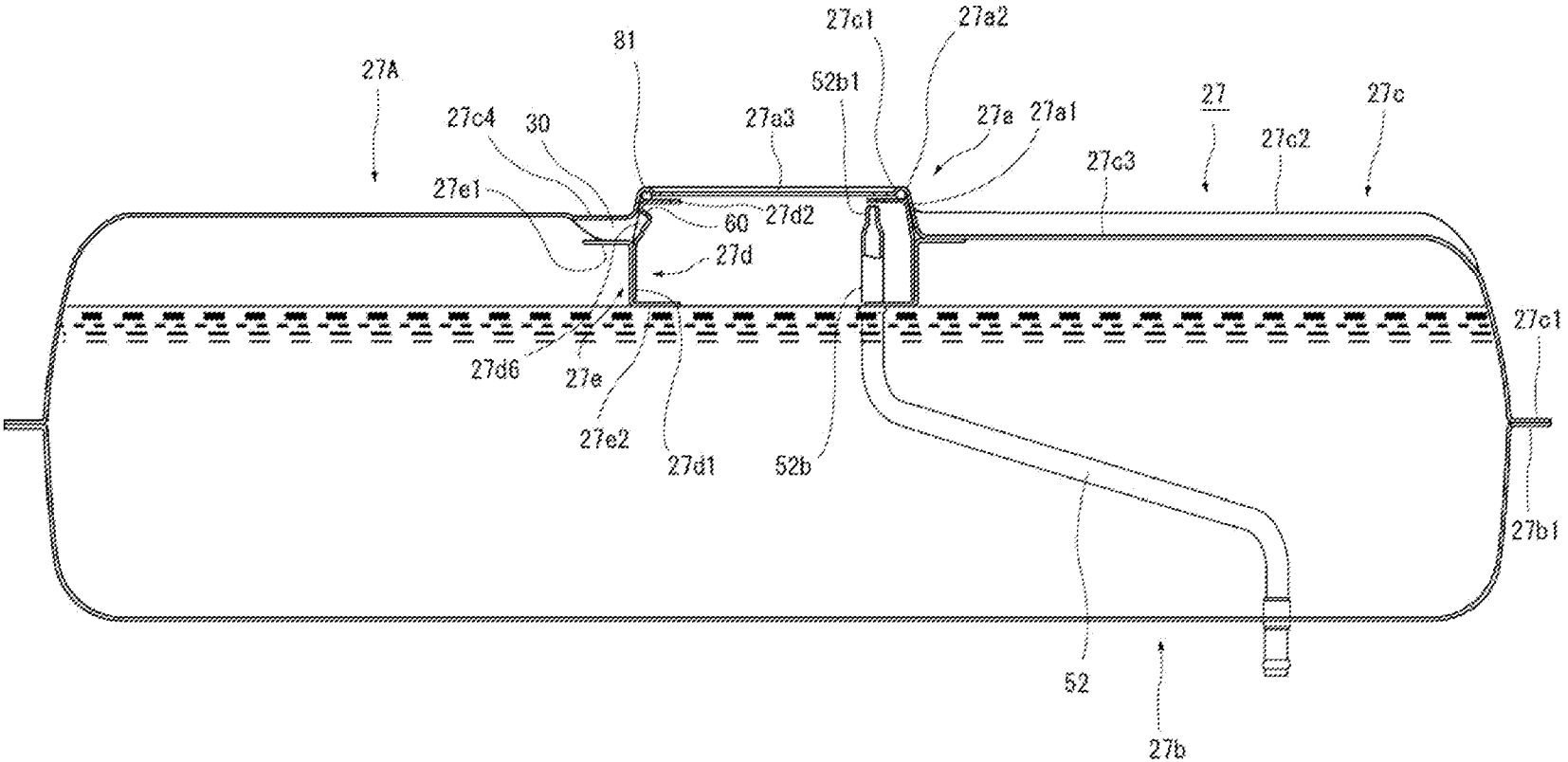
FIG. 2 is a cross-sectional view of the fuel tank in FIG. 1.
Figure 3:
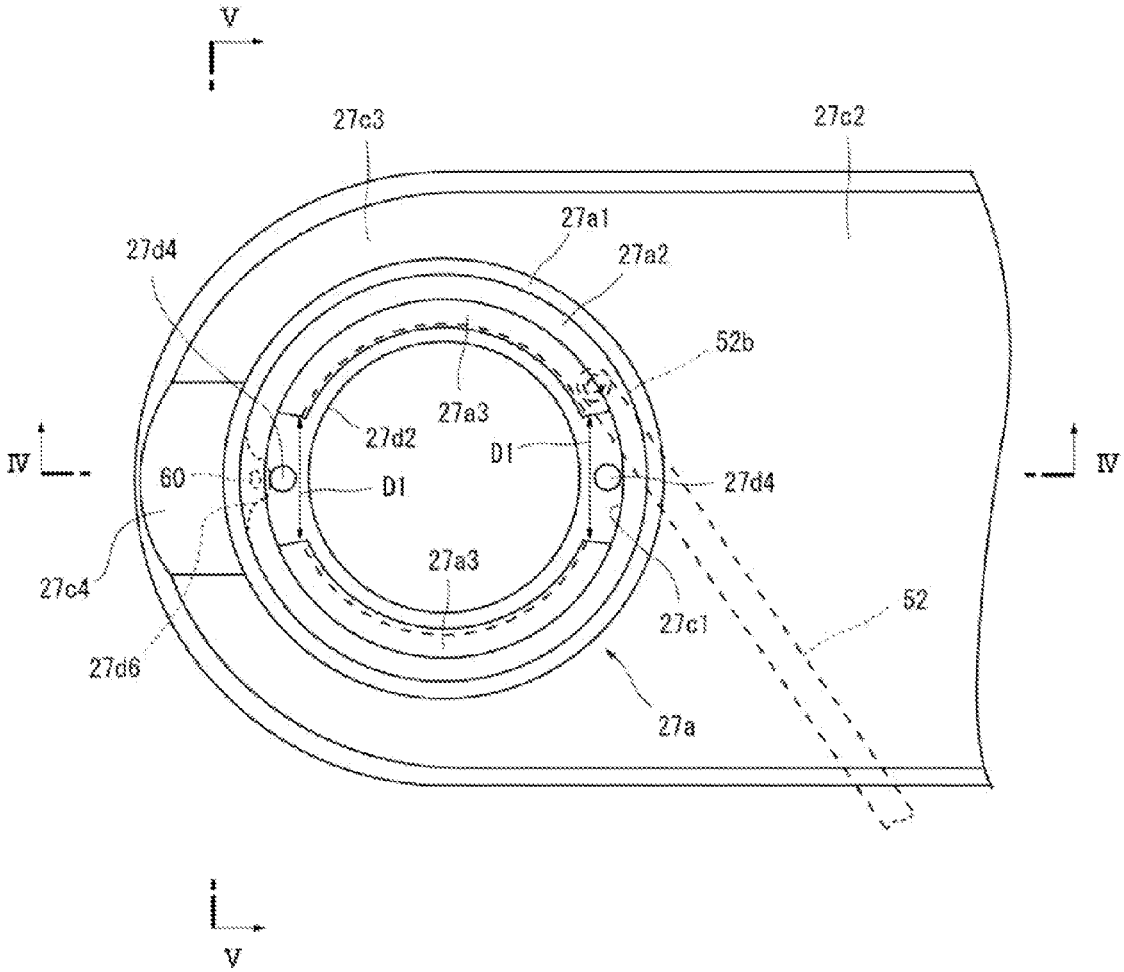
FIG. 3 is a plan view of a fuel inlet with a fuel cap removed therefrom.
Figure 4:
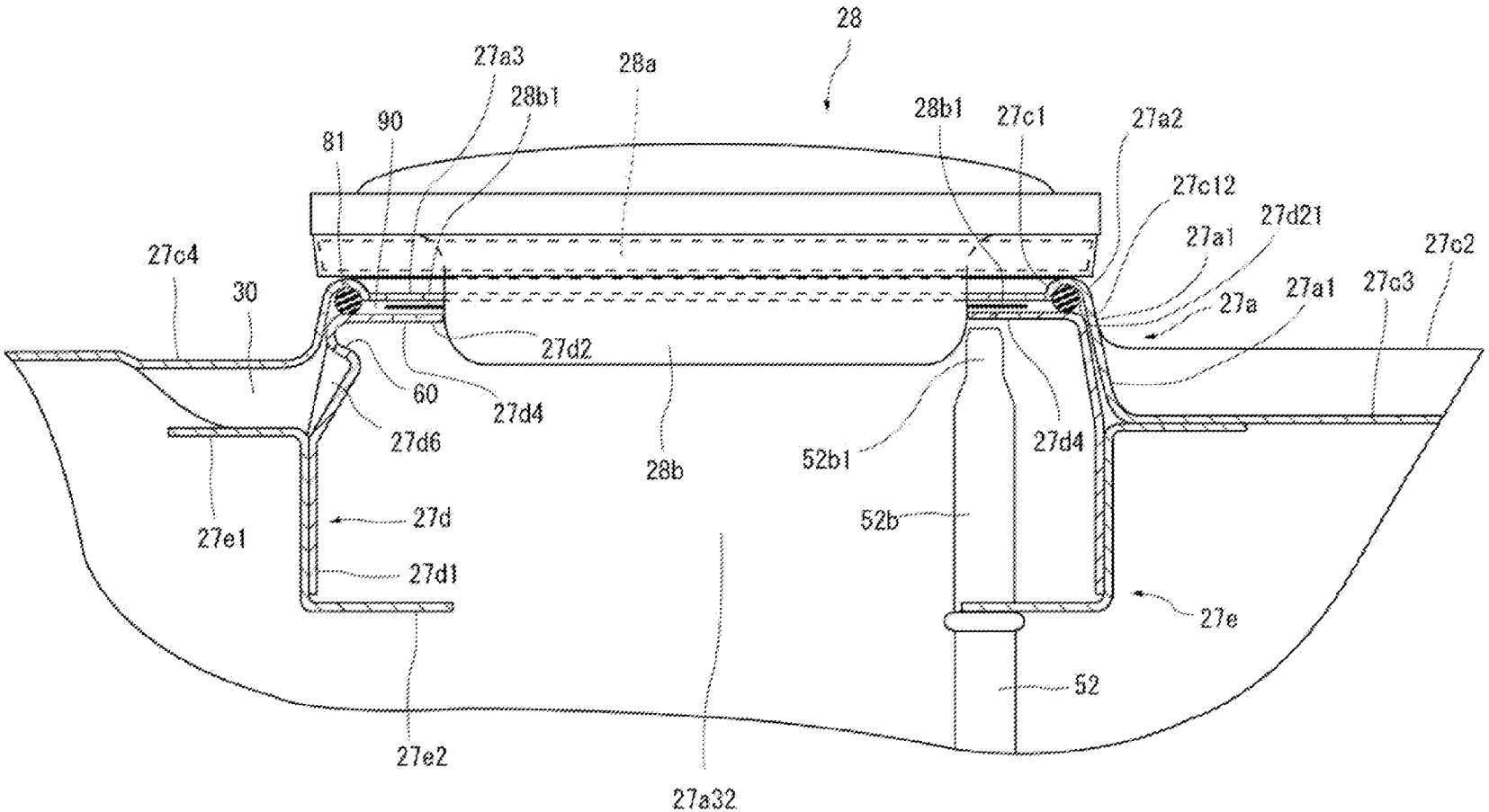
FIG. 4 is a cross-sectional view taken along line IV-IV of FIG. 3 with the fuel cap installed.
Figure 5:
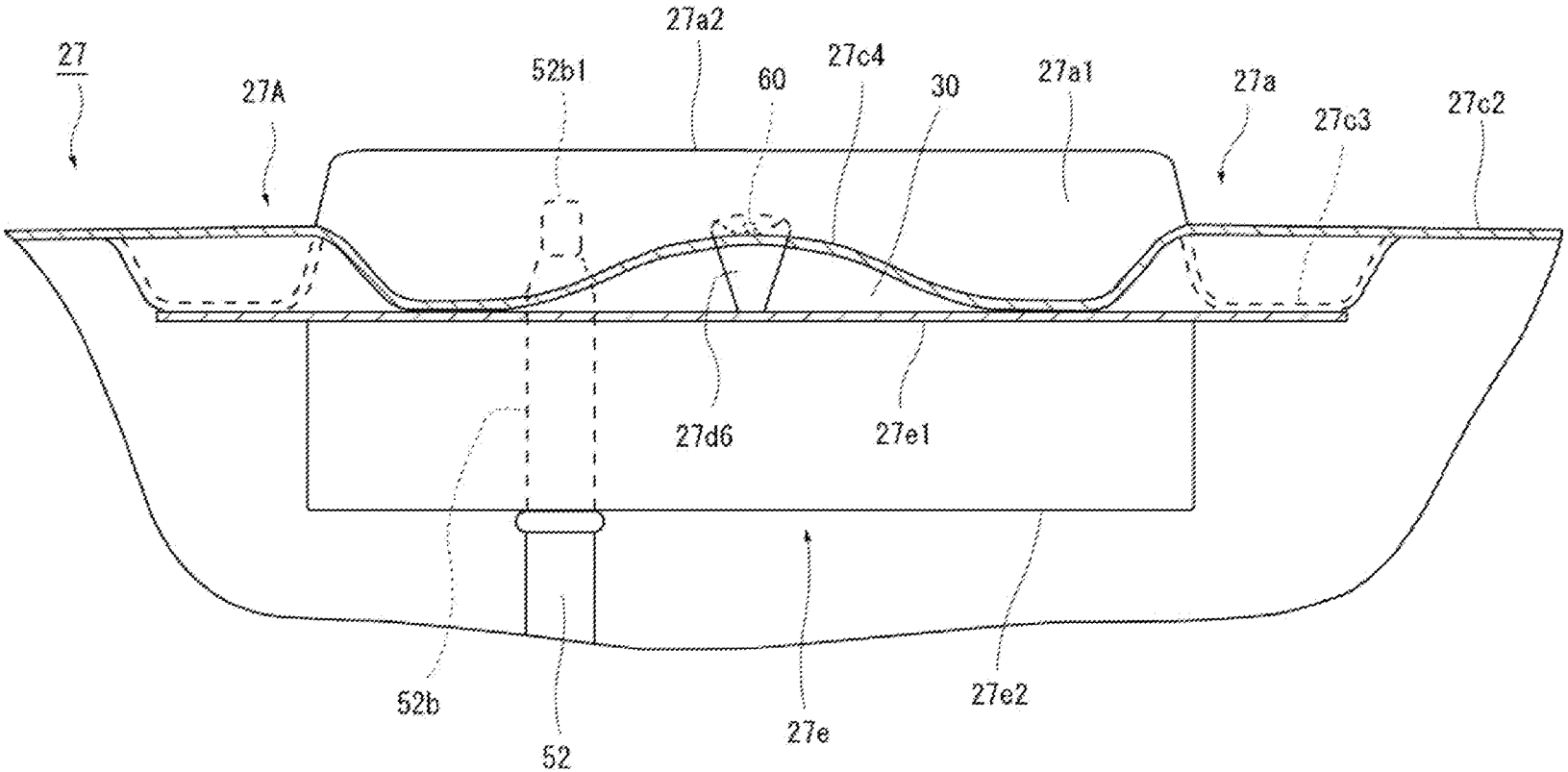
FIG. 5 is a cross-sectional view taken along line V-V of FIG. 3 with the fuel cap removed from the fuel inlet.

The fuel tank 27 will be described below. FIG. 2 is a cross-sectional view of the fuel tank 27. FIG. 3 is a plan view of the fuel inlet 27*a* with the fuel cap 28 removed. FIG. 4 is a cross-sectional view taken along line IV-IV of FIG. 3 with the fuel cap 28 installed. FIG. 5 is a cross-sectional view taken along line V-V of FIG. 3 with the fuel cap 28 removed from the fuel inlet 27*a*.

The fuel tank 27 includes the tank body 27A for storing fuel therein and the fuel inlet 27*a* provided on a top face of the tank body 27A, projecting upwardly therefrom, and the fuel cap 28 is removably installed on the fuel inlet 27*a*. The fuel cap 28 can include, at its center, a fit-in portion 28*b* that protrudes downwardly in a bowl shape and the annular seal 28*a* provided on the periphery of the fit-in portion 28*b*. When an engaging projection 28*b*1 formed on a part of the periphery of the fit-in portion 28*b* engages with an engaging groove 90 in the fuel inlet 27*a*, the annular seal 28*a* seals the opening in the fuel inlet 27*a*.

The fuel tank 27 includes a casing lower section 27*b* and a casing upper section 27*c*, each of which can be made of a metal plate and formed into a dish-like shape, and has a flange 27*b*1, 27*c*1 respectively. The casing lower section 27*b* and the casing upper section 27*c* can be welded together with the flange 27*b*1 and the flange 27*c*1 contacting each other, thereby forming the tank body 27A for storing fuel therein.

A circular opening 27*c*1 can be defined in a center area of the casing upper section 27*c*. A rim of the opening 27*c*1 can project upwardly from a top face 27*c*2 of the casing upper section 27*c*, thereby forming the fuel inlet 27*a*. More specifically, the fuel inlet 27*a* constituted by the casing upper section 27*c* can include an upstanding portion 27*a*1 that extends upwardly from the casing upper section 27*c*, an annular engaging portion 27*a*2 that can have a semicircular cross-sectional profile and bends inward of the opening from the upstanding portion 27*a*1, and a pair of arcuate engaging lugs 27*a*3 provided on an inner side of the annular engaging portion 27*a*2. The engaging lugs 27*a*3 are opposed to each other with a predetermined gap therebetween.

A recess 27*c*3, which can have a semicircular shape, can be defined by recessing a left-side portion from the center, that is, where the engine 31 and the generator 32 are provided below, of an area surrounding the fuel inlet 27*a* of the casing upper section 27*c*. A right-side portion of the area is recessed to have the same depth as the semicircular portion and continuously extend therefrom. The right side corresponds to a side at which the suction fan 31*d* of the engine 31 is provided below. The center of the semicircular portion of the recess 27*c*3 can be bulged in an arch shape to form, a bulged portion 27*c*4 so that fuel that overflows from the fuel inlet 27*a* during fueling flows through the recess 27*c*3 onto a side of the engine 31 where the suction fan 31*d* is located.

An annular seal 81 is disposed so as to engage with the inside of the annular engaging portion 27*a*2 of the fuel inlet 27*a*. A cylindrical member 27*d* can be disposed in the fuel inlet 27*a*. The cylindrical member 27*d* has a lower end 27*d*1 that is open at a position lower than the top face 27*c*2, which is an upper end of the casing upper section 27*c*, of the tank body 27A. The cylindrical member 27*d* projects downward with a space between an outer circumferential surface 27*d*21 of an upper end portion 27*d*2 of the cylindrical member 27*d* and an inner circumferential surface 27*c*12 of the fuel inlet 27*a* hermetically sealed by the seal 81.

The annular seal 81 is interposed between the outer circumferential surface 27*d*21 of the upper end portion 27*d*2 of the cylindrical member 27*d* and the inner circumferential surface 27*c*12 of the fuel inlet 27*a* and capable of reliably maintaining hermeticity of the space between the outer circumferential surface 27*d*21 and the inner circumferential surface 27*c*12.

In this embodiment, an O-ring is employed as the seal 81. However, in another embodiment, the O-ring serving as the seal 81 can be omitted when the hermeticity is maintained by press-fitting the cylindrical member 27*d* into the fuel inlet 27*a*.

With reference to FIG. 3, the engaging groove 90 is defined between the upper end portion 27*d*2 of the cylindrical member 27*d* and the pair of arcuate engaging lugs 27*a*3. The pair of arcuate engaging lugs 27*a*3 can be spaced from each other to have a gap D1 between opposing ends of the arcuate engaging lugs 27*a*3. The fuel cap 28 is installed on the fuel cap 27*a* by inserting the engaging projection 28*b*1 of the fit-in portion 28*b* into fuel inlet 27*a* through the gaps D1 between the pair of arcuate engaging lugs 27*a*3, and then rotating the fuel cap 28 clockwise or counterclockwise so that the engaging projection 28*b* is engaged in the engaging groove 90. Consequently, the fuel cap 28 is installed on the fuel cap 27*a* with the annular seal 28*a* sealing the opening in the fuel inlet 27*a*. An opening 27*d*4 is defined in the upper end portion 27*d*2 of the cylindrical member 27*d* at a position corresponding to the gap D1, thereby causing fuel adhering onto the upper end portion 27*d*2 to fall through the opening 27*d*4.

The cylindrical member 27*d* is provided in an annular member 27*e*. The annular member 27*e* can include a flange 27*e*1 formed around the periphery of an upper end of the annular member 27*e*, and have a lower end portion 27*e*2 that is open. Because the bulged portion 27*c*4 is formed by bulging the center of the semicircular portion of the recess 27*c*3 in the arch shape in a state in which the cylindrical member 27*d* is installed in the annular member 27*d*, a cavity 30 can be defined between the bulged portion 27*c*4 and the flange 27*e*1 of the annular member 27*e*.

An upper portion of the cylindrical member 27 can be partially dented to form an upwardly-facing face portion 27*d*6, in which a small-opening communicating passage 60 is formed. Thus, the small-opening communicating passage 60 extending substantially vertically can be formed in the face portion 27*d*6 with a simple structure.

As described above, the small-opening communicating passage 60 is formed in the upper end portion of the cylindrical member 27*d*. The small-opening communicating passage 60 brings the inside of the cylindrical member 27*d* into communication with a portion, which is lower than the hermetically sealed space, of the outside of the cylindrical member 27*d*.

The cavity 30 for bringing the outside of the annular member 27*e* in the tank body 27A into communication with the small-opening communicating passage 60 is formed between the top face 27*c*2 of the tank body 27A and the flange 27*e*1 of the annular member 27*e*. Because the flange 27*e*1 functions as a shielding wall that prevents fuel in the tank body 27A from intruding via a portion lower than the small-opening communicating passage 60, air in the tank body 27A can easily escape through the small-opening communicating passage 60. The upstream end 52*b* of the discharging passage 52 is connected with the cylindrical member 27*d*. The discharging passage 52 has a small hole in its upper end portion 52*b*1 at a position higher than the lower end 27*d*1 of the cylindrical member 27*d*.

Figure 6:
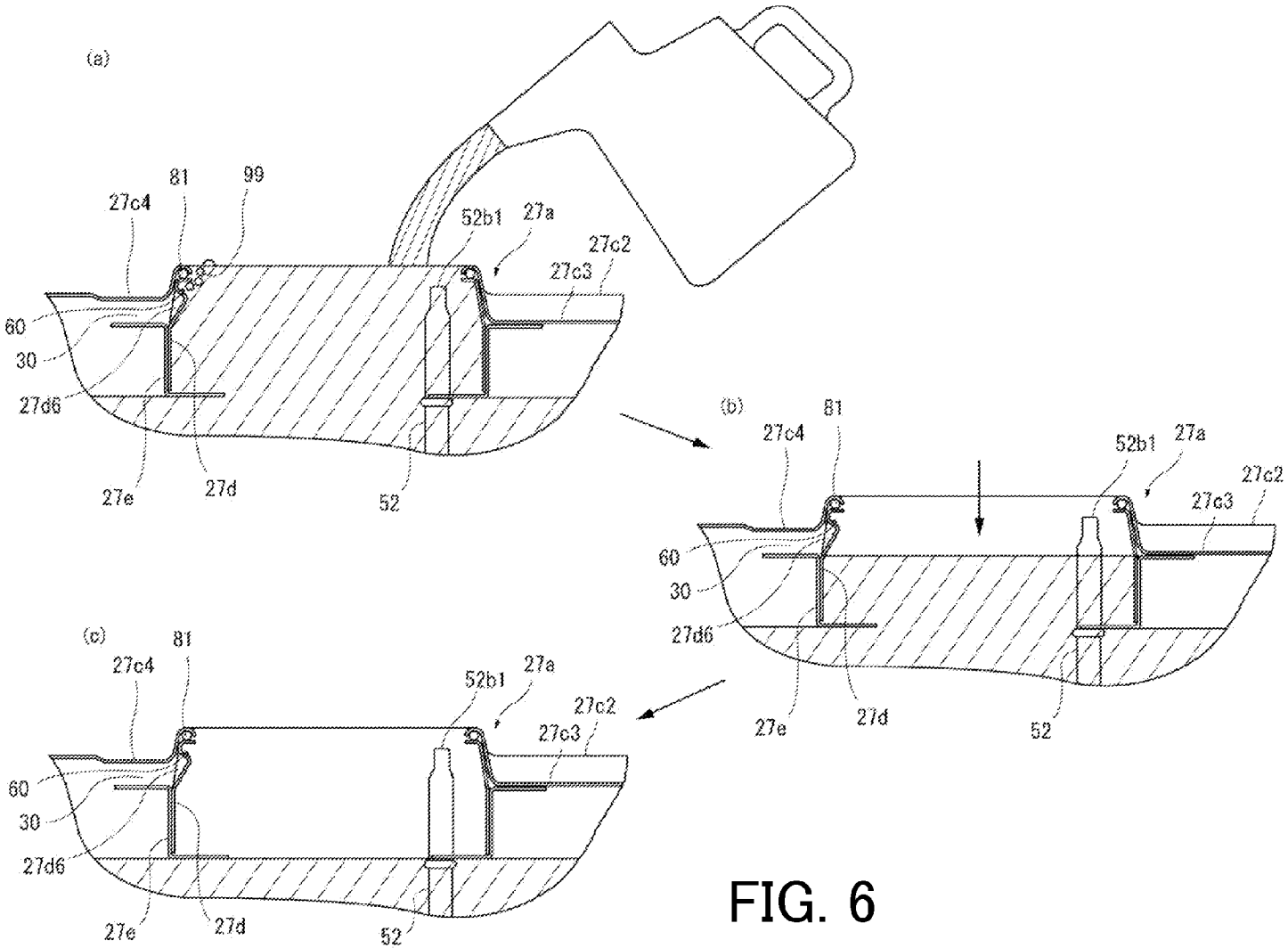
FIG. 6 is an explanatory view of a state in which fuel is oversupplied into the fuel tank to overflow from an upper end portion of the fuel inlet.

Next, with reference to FIG. 6, a state in which fuel is oversupplied into the fuel tank 27 so as to overflow from the upper end portion of the fuel inlet 27*a* will be described. For fueling the fuel tank 27, fuel is supplied to the tank body 27A through the fuel inlet 27*a* with the fuel cap 28 removed. During this fueling, fuel can be oversupplied so as to overflow from the upper face of the fuel inlet 27*a* due to a careless operation of an operator or a like.

Because the small-opening communicating passage 60 extends substantially vertically, when fuel is oversupplied and overflows from the upper end portion of the fuel inlet 27*a*, air in the tank body 27A enters via the cavity 30 into the fuel inlet 27*a* through the small-opening communicating passage 60. Thereafter, a buoyant force urges bubbles 99 evolved from the fuel and air in the fuel inlet 27*a* to move upward, thereby causing the air to escape out of the fuel inlet 27*a* (FIG. 6A). Consequently, a liquid level of fuel in the fuel inlet 27*a* declines (FIG. 6B), and hence a liquid level of fuel in the tank body 27A rises. Because the discharging passage 52 in communication with the canister 50 has an opening in the upper end portion 52*b*1 at the position higher than the liquid level of the fuel, undesirable flowing of the fuel into the canister 50 through the discharging passage 52 is inhibited (FIG. 6C).

In certain embodiments, because the small-opening communicating passage extends substantially vertically, a buoyant force urges bubbles evolved from fuel and air in the tank body to move upward. Hence, the bubbles easily escape from the small-opening communicating passage. Consequently, the liquid level in the fuel inlet is lowered to cause the opening in the discharging passage that is in communication with the canister to be positioned higher than the liquid level of the fuel. Hence, undesirable flowing of the fuel into the canister through the discharging passage is prevented.

The embodiments of the present invention described above can be employed to prevent fuel from flowing into the canister during fueling, and can prevent fuel from unintentionally flowing into the canister during fueling.

Although these inventions have been disclosed in the context of a certain preferred embodiments and examples, it will be understood by those skilled in the art that the present inventions extend beyond the specifically disclosed embodiments to other alternative embodiments and/or uses of the inventions and obvious modifications and equivalents thereof. In addition, while a number of variations of the inventions have been shown and described in detail, other modifications, which are within the scope of the inventions, will be readily apparent to those of skill in the art based upon this disclosure. It is also contemplated that various combinations or subcombinations of the specific features and aspects of the embodiments may be made and still fall within one or more of the inventions. Accordingly, it should be understood that various features and aspects of the disclosed embodiments can be combine with or substituted for one another in order to form varying modes of the disclosed inventions. Thus, it is intended that the scope of the present inventions herein disclosed should not be limited by the particular disclosed embodiments described above.

What is claimed is:

1. A fuel tank comprising:

a tank body arranged to store fuel therein, the tank body including a fuel inlet extending upwardly from a top surface of the tank body and a cylindrical member extending downwardly from the fuel inlet;

a fuel cap arranged to be removably installed onto a top of the fuel inlet; and a discharge member including a discharge passage in communication with a canister arranged to adsorb fuel vapor from the tank body; wherein the cylindrical member includes a lower end portion and an upper end portion, the lower end portion arranged lower than the top surface of the tank body and projecting downwardly in the fuel inlet, the upper end portion including a communicating passage arranged to bring an inside of the cylindrical member into communication with an outside of the cylindrical member, an outer circumferential surface of the upper end portion and an inner circumferential surface of the fuel inlet defining a space therebetween maintained in a hermetically sealed state, the communicating passage being arranged lower than the hermetically sealed space and to extend substantially vertically;

the discharge member includes an opening on the inside of the cylindrical member at a position higher than the lower end portion of the cylindrical member; and the communicating passage is arranged, during fueling of the fuel tank, to allow air to escape from the tank body into the fuel inlet.

2. The fuel tank of claim 1, wherein the upper end portion of the cylindrical member is partially indented to define an upwardly-facing surface, and the communicating passage is provided in the upwardly-facing surface.

3. The fuel tank of claim 1, further comprising an annular seal disposed between the outer circumferential surface of the cylindrical member and the inner circumferential surface of the fuel inlet, the seal arranged to hermetically seal the space between the outer circumferential surface of the upper end portion of the cylindrical member and the inner circumferential surface of the fuel inlet.

4. The fuel tank of claim 1, further comprising:

an annular member including a flange arranged externally around an upper edge of the annular member and an opening in a lower end portion thereof; wherein the cylindrical member is disposed within the annular member;

the flange of the annular member is attached to the top surface of the tank body with the cylindrical member disposed within the annular member;

a cavity is defined between the top surface of the tank body and the flange of the annular member; and the cavity is arranged to communicate a space outside of the annular member with the communicating passage.

5. A fuel tank comprising:

a tank body arranged to store fuel therein, the tank body including a fuel inlet extending upwardly from a top surface of the tank body and a cylindrical member extending downwardly from the fuel inlet, the fuel inlet arranged to be removably coupled to a fuel cap;

a discharge member including a discharge passage in communication with an inside portion of the cylindrical member and with a canister arranged to adsorb fuel vapor from the tank body, the discharge member including an opening positioned higher than a lower end portion of the cylindrical member; wherein the cylindrical member includes a distal end positioned below the top surface of the tank body;

an outer surface of the cylindrical member and an inner surface of the fuel inlet define a sealed space therebetween;

the cylindrical member includes a communicating passage arranged to communicate the inside portion of the cylindrical member with an outside portion of the cylindrical member, the outside portion being lower than the sealed space; and the communicating passage is arranged, during fueling of the fuel tank, to allow air to escape from the tank body into the fuel inlet.

6. The fuel tank of claim 5, wherein the communicating passage extends substantially vertically.

7. The fuel tank of claim 5, further comprising an annular seal disposed between the outer surface of the cylindrical member and the inner surface of the fuel inlet, the seal configured to hermetically seal the sealed space between the outer surface of the cylindrical member and the inner surface of the fuel inlet.

8. A fuel tank comprising:

a tank body arranged to store fuel therein;

a fuel inlet extending upwardly from a top surface of the tank body, the fuel inlet arranged to be removably coupled to a fuel cap;

a communicating passage arranged in the tank body to allow air in the tank body to enter the fuel inlet when the fuel cap is removed and fuel is oversupplied into and overflows from the fuel inlet; wherein the air is allowed to escape out of the fuel inlet so that a fuel level in the fuel inlet declines and a fuel level in the tank body rises.

9. The fuel tank of claim 8, wherein the communicating passage communicates an inside of the tank body containing the air with the fuel inlet.

* * * * *